US007341233B2

(12) United States Patent
McMains

(10) Patent No.: US 7,341,233 B2
(45) Date of Patent: Mar. 11, 2008

(54) HORIZONTAL ADJUSTMENT MECHANISM FOR USE ON A CHAIR SEAT

(75) Inventor: Kevin McMains, Holland, MI (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 10/664,557

(22) Filed: Sep. 19, 2003

(65) Prior Publication Data

US 2005/0061941 A1 Mar. 24, 2005

(51) Int. Cl.
*F16M 13/00* (2006.01)
*A47C 1/00* (2006.01)

(52) U.S. Cl. ..... 248/424; 248/429; 297/312; 297/411.35

(58) Field of Classification Search ..... 248/424, 248/429, 393, 425, 430, 298.1; 297/312, 297/313, 317, 322, 335, 337, 411.35, 411.37
See application file for complete search history.

(56) References Cited

U.S. PATENT DOCUMENTS

| | | | | |
|---|---|---|---|---|
| 134,627 | A | 1/1873 | Barney | |
| 942,818 | A | 12/1909 | Flindall | |
| 1,621,520 | A | 3/1927 | Snyder | |
| 1,769,242 | A | 7/1930 | Toncray | |
| 1,922,418 | A | 8/1933 | Conant | |
| 1,987,851 | A | 1/1935 | Holman | |
| 2,021,120 | A | 11/1935 | Wilkins | |
| 2,446,185 | A | 8/1948 | Masucci, et al. | |
| 2,855,026 | A | 10/1958 | Simons, et al. | |
| 2,988,398 | A | 6/1961 | Hamilton | |
| 3,090,647 | A | 5/1963 | Moore | |
| 3,144,270 | A | 8/1964 | Bilancia | |
| 3,235,308 | A | 2/1966 | Conner | |
| 3,408,106 | A | 10/1968 | Bolling, et al. | |
| 3,511,533 | A | 5/1970 | Drabert | |
| 3,526,430 | A | 9/1970 | Eldon | |
| 3,785,700 | A | 1/1974 | Kubo | |
| 3,821,845 | A | 7/1974 | Bailey | |
| 3,982,785 | A | 9/1976 | Ambasz | |
| 4,054,318 | A | 10/1977 | Costin | |
| 4,084,850 | A | 4/1978 | Ambasz | |
| 4,210,303 | A * | 7/1980 | Torta et al. | 248/429 |
| 4,221,430 | A | 9/1980 | Frobose | |
| 4,401,343 | A | 8/1983 | Schmidt | |
| 4,491,366 | A | 1/1985 | Silber | |
| 4,555,085 | A | 11/1985 | Bauer | |

(Continued)

*Primary Examiner*—Carl D. Friedman
*Assistant Examiner*—Tan Le
(74) *Attorney, Agent, or Firm*—Shook, Hardy & Bacon, L.L.P.

(57) ABSTRACT

In a chair having a base, a seat defining a fore-to-aft longitudinal axis, a seat back and a tilt control mechanism, a horizontal adjustment mechanism is provided for allowing fore-to-aft movement of the seat relative to the seat back. The mechanism includes a first plate adapted to be coupled to the seat; a second plate adapted to be coupled either directly to the base or to the tilt control mechanism, the second plate being slidably coupled to the first plate such that the two plates can move relative to one another along the longitudinal axis of the seat; an intermediate element positioned between the first and second plates for facilitating relative sliding movement therebetween, and a handle positioned between first and second plates that selectively positions the first plate in relation to the second plate.

33 Claims, 6 Drawing Sheets

U.S. PATENT DOCUMENTS 4,560,200 A 12/1985 Giannelli, et al.
4,648,654 A 3/1987 Voss
4,648,656 A 3/1987 Kimura
4,687,251 A 8/1987 Kazaoka, et al.
4,732,424 A 3/1988 Uredat-Neuhoff
4,786,081 A 11/1988 Schmidt
4,790,600 A 12/1988 Behringer
4,796,951 A 1/1989 Tamura, et al.
4,981,326 A 1/1991 Heidmann
5,035,466 A 7/1991 Mathews, et al.
5,048,893 A 9/1991 Cowan, et al.
5,171,062 A 12/1992 Courtois
5,172,882 A 12/1992 Nini
5,192,045 A * 3/1993 Yamada et al. ..... 248/430
5,234,189 A * 8/1993 Myers ..... 248/429
5,358,207 A 10/1994 West
5,370,444 A 12/1994 Stulik
5,390,978 A 2/1995 Janisch
5,431,360 A 7/1995 Yu
5,520,438 A 5/1996 Stulik
5,531,168 A 7/1996 Towfigh
5,582,460 A 12/1996 Schultz
5,603,551 A 2/1997 Sheehan
5,607,204 A 3/1997 Gryp
5,660,442 A 8/1997 Tornero
5,678,886 A * 10/1997 Infanti ..... 297/217.3
5,755,488 A 5/1998 Beda, et al.
5,755,490 A 5/1998 Lamart
5,871,258 A 2/1999 Battey, et al.
5,884,887 A 3/1999 Garelick, et al.
5,909,923 A 6/1999 DeKraker
5,947,559 A 9/1999 Williams
5,961,088 A 10/1999 Chabanne, et al.
6,010,194 A 1/2000 Cykon
6,027,168 A 2/2000 Crossman
6,135,412 A * 10/2000 Buehler ..... 248/421
6,135,556 A 10/2000 Chu
6,273,384 B1 * 8/2001 Hallmark et al. ..... 248/297.31
6,336,619 B1 * 1/2002 Wahls ..... 248/424
6,572,195 B1 * 6/2003 Lee ..... 297/411.37
6,772,985 B2 * 8/2004 Lee ..... 248/424
6,799,803 B1 * 10/2004 Lee et al. ..... 297/411.35
6,986,550 B2 * 1/2006 Gevaert et al. ..... 297/337
2005/0061941 A1 * 3/2005 McMains ..... 248/424

* cited by examiner

HORIZONTAL ADJUSTMENT MECHANISM FOR USE ON A CHAIR SEAT

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

This invention relates generally to chair control mechanisms, and more particularly to a mechanism that allows the horizontal fore-to-aft position of a chair seat to be adjusted relative to the back of the seat back.

Typical office chairs and the like may have an adjustment mechanism for permitting horizontal fore-to-aft adjustment of a seat. Such mechanisms generally include guide channels or tracks attached to the seat or base within which bearing members, such as depending rods or runners, are received to permit horizontal fore-to-aft movement of the seat relative to the seat back. Often the front edge of the seat, or a front or side lever, must be raised or depressed to permit such movement. A protruding member is typically provided which engages a particular hole or indentation in the guide channel to prevent movement upon release of the seat or lever.

Chairs employing constructions such as these suffer from a number of drawbacks. For instance, such mechanisms typically include a number of parts which individually must be machined and assembled. This leads to increased cost of manufacture and assembly. Additionally, such mechanisms are often bulky and increase the overall height of the seat such that it cannot be adjusted low enough to the ground to accommodate those in the lower height percentiles of the population. Furthermore, prior art mechanisms may be equipped with one or more levers or adjustment knobs that can clutter valuable space under the chair.

Another typical office chair is designed to be self adjusting when the user shifts his or her weight. These designs use a detent and notch arrangement to adjust the fore-to-aft movement of the seat relative to the seat back. A detent is typically provided which engages a particular recess or notch to prevent movement when the user is seated and disengages when the user removes his or her weight from the seat.

Chairs employing constructions such as these also suffer from a number of drawbacks. For instance, the detent and notch arrangement allows for a substantial amount of side-to-side movement. Further, chairs employing these constructions require the user to stand up or unweight the chair allowing the detent to disengage from the notch before the fore-to-aft movement may take place. Still further, with the detent and notch arrangement, the detent may also disengage due to the partial removal of weight from the seat when a user reclines the chair. This results in unwanted movement of the chair from the fore-to-aft position.

Accordingly, there remains a need in the adjustable chair industry for a horizontal adjustment mechanism which is relatively simple, compact, and inexpensive to manufacture and assemble, which is capable of adjustment while the user is sitting, which is capable of accommodating individuals falling outside height norms, and which changes the height of the chair seat only nominally upon assembly.

SUMMARY OF THE INVENTION

Accordingly, in one of its aspects, the present invention provides a horizontal adjustment mechanism for a chair, wherein the mechanism can be employed between a conventional seat and a tilt control mechanism without requiring modification to either part.

In another of its aspects, the present invention provides a horizontal adjustment mechanism for a chair that presents a relatively low profile which does not significantly increase the overall height of the seat relative to the ground.

In still another of its aspects, the present invention provides a horizontal adjustment mechanism for a chair that is movable only when adjusted by the user.

In accordance with these and other aspects evident from the following description of a preferred embodiment, a horizontal adjustment mechanism is provided that is suited for use on a chair that has a base, a seat supported on the base that defines a fore-to-aft longitudinal axis, and a seat back. The mechanism includes a first plate that is adapted to be coupled to the seat and a second plate that is adapted to be coupled to the base. The second plate is slidably coupled to the first plate such that the two plates can move relative to one another along the longitudinal axis of the seat. An adjustment lever and intermediate element are positioned between the first and second plates and facilitate relative sliding movement between the two plates.

The present invention further provides a horizontal adjustment mechanism that is particularly suited for use on a chair having a seat which defines a fore-to-aft longitudinal axis, a base on which the seat is supported, a seat back, and a tilt control mechanism which allows the seat to be tilted relative to the base. The mechanism includes a first plate adapted to be coupled to a bottom surface of the seat and a second plate adapted to be coupled to an upper surface of the tilt control mechanism. The second plate is slidably coupled to the first plate such that the first and second plates can move relative to one another along the longitudinal axis of the seat. A spacer is positioned between the two plates for facilitating relative sliding movement therebetween. The two plates along with the adjustment lever cooperate to provide a means for selectively adjusting the seat along the longitudinal axis thereof.

Additional aspects of invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means, instrumentalities and combinations particularly pointed out in the appended claims.

BRIEF DESCRIPTION OF THE SEVERAL VIEWS OF THE DRAWINGS

In the accompanying drawings which form a part of the specification and are to be read in conjunction therewith and in which like reference numerals are employed to indicate like parts in the various views.

DETAILED DESCRIPTION OF THE INVENTION

Figure 1:
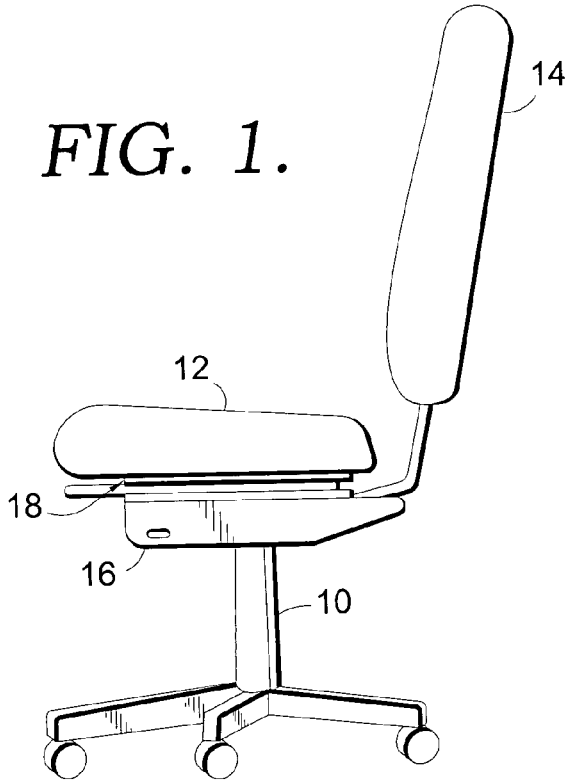
FIG. 1 is a perspective view of a chair control mechanism constructed in accordance with the preferred embodiment of the present invention, illustrating the mechanism assembled on a chair.

A horizontal adjustment mechanism for use on a chair constructed in accordance with the preferred embodiment of the present invention is shown in FIG. 1, assembled on a conventional chair having a base 10, a seat 12 supported on the base for relative movement, a seat back 14 and a tilt control mechanism 16. The particular constructions of the base 10, seat 12, seat back 14 and tilt control mechanism 16 shown in the drawing do not form a part of the present invention and are provided for illustrative purposes only, it being understood that the present invention can be adapted for use with any known chair having a base and a seat, whether or not the chair also includes a tilt control mechanism, such that the horizontal fore-to-aft position of the seat may be adjusted. In the preferred embodiment, the horizontal adjustment mechanism of the present invention is used with tilt control mechanism models 4752 and 5600, manufactured by Leggett & Platt, Inc., which are designed for use on chairs having J-shaped seat backs. It should, of course, be understood that the horizontal adjustment mechanism of the present invention can be used on any of a variety of chairs, which may or may not include tilt control mechanisms.

Figure 3:
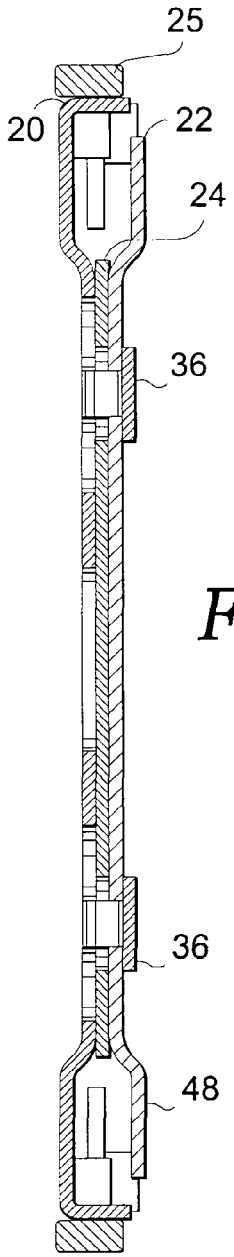
FIG. 3 is a cross-sectional view of the assembled mechanism of the present invention taken along line 3-3 of FIG. 2.

As best seen in FIGS. 1 and 3, the horizontal adjustment mechanism 18, in the preferred embodiment, is adapted to be interposed between the seat 12 and the control mechanism 16 during assembly of the chair, and broadly includes a first plate 20 secured to the underside of the seat, a second plate 22 secured to the upper surface of the control mechanism 16, an intermediate element or spacer 24 interposed between the first and second plates 20, 22 for facilitating relative sliding movement therebetween, and an adjustment lever 25. In chair constructions void of tilt control mechanisms, the horizontal adjustment mechanism of the present invention may be interposed between the seat 12 and the base 10, with the second plate secured directly to the base. In this embodiment, the base 10 would be equipped with a formed base plate, to which the second plate 22 is attached.

Figure 4:
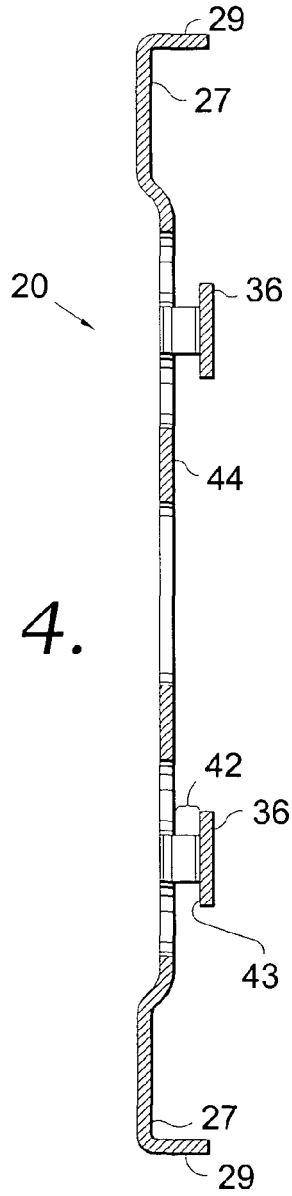
FIG. 4 is a cross-sectional view of the first plate of the adjustment mechanism of the present invention taken along line 4-4 of FIG. 5.
Figure 5:
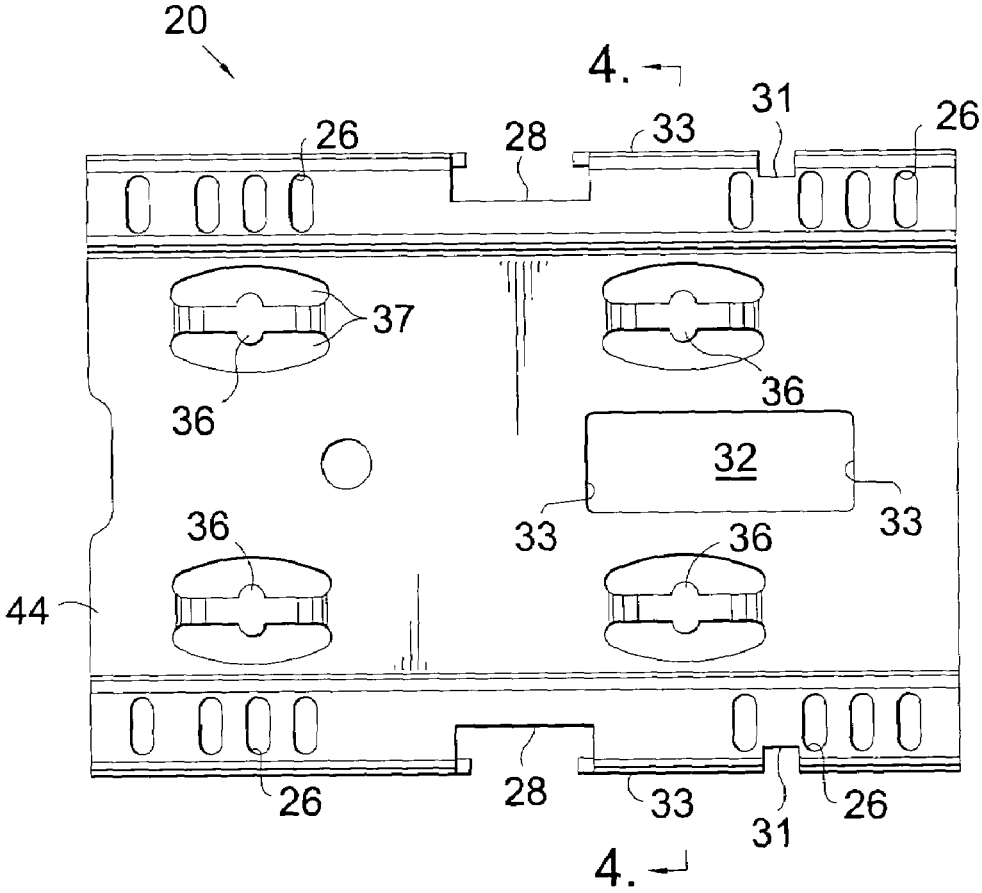
FIG. 5 is a top view of the first plate constructed in accordance with a preferred embodiment of the present invention.

First plate 20 is illustrated in FIGS. 4 and 5 and includes a plurality of mounting holes 26 near the perimeter thereof which facilitate fastening the plate 20 to the bottom of the seat 12. First plate 20 is generally planar, presenting top and bottom surfaces and front, rear and side edges. As is best seen in FIG. 4, each of the side edges is stepped to present a raised profile portion 27 in which mounting holes 26 are formed for receiving fasteners to fasten the plate to the seat. Raised profile portions 27 are thus raised above the central portion of plate 20. As is best seen in FIG. 5, the mounting holes 26 are preferably arranged in sets and each set presents a pattern corresponding to that of the mounting holes of the control mechanism 16 and the seat 12 such that the horizontal adjustment mechanism 18 may be interposed between the control mechanism and the seat without requiring modification of either part. As such, the adjustment mechanism 18 can be offered in combination with any conventional chair, including or not including a control mechanism, to permit fore-to-aft adjustment of the chair seat relative to the seat back. Preferably, multiple sets of mounting holes 26 are formed in the first plate 20 so that the adjustment mechanism may be assembled on the seat in multiple fore-to-aft positions. However, it is possible to form the plate with only a single set of mounting holes if desired.

Figure 8:
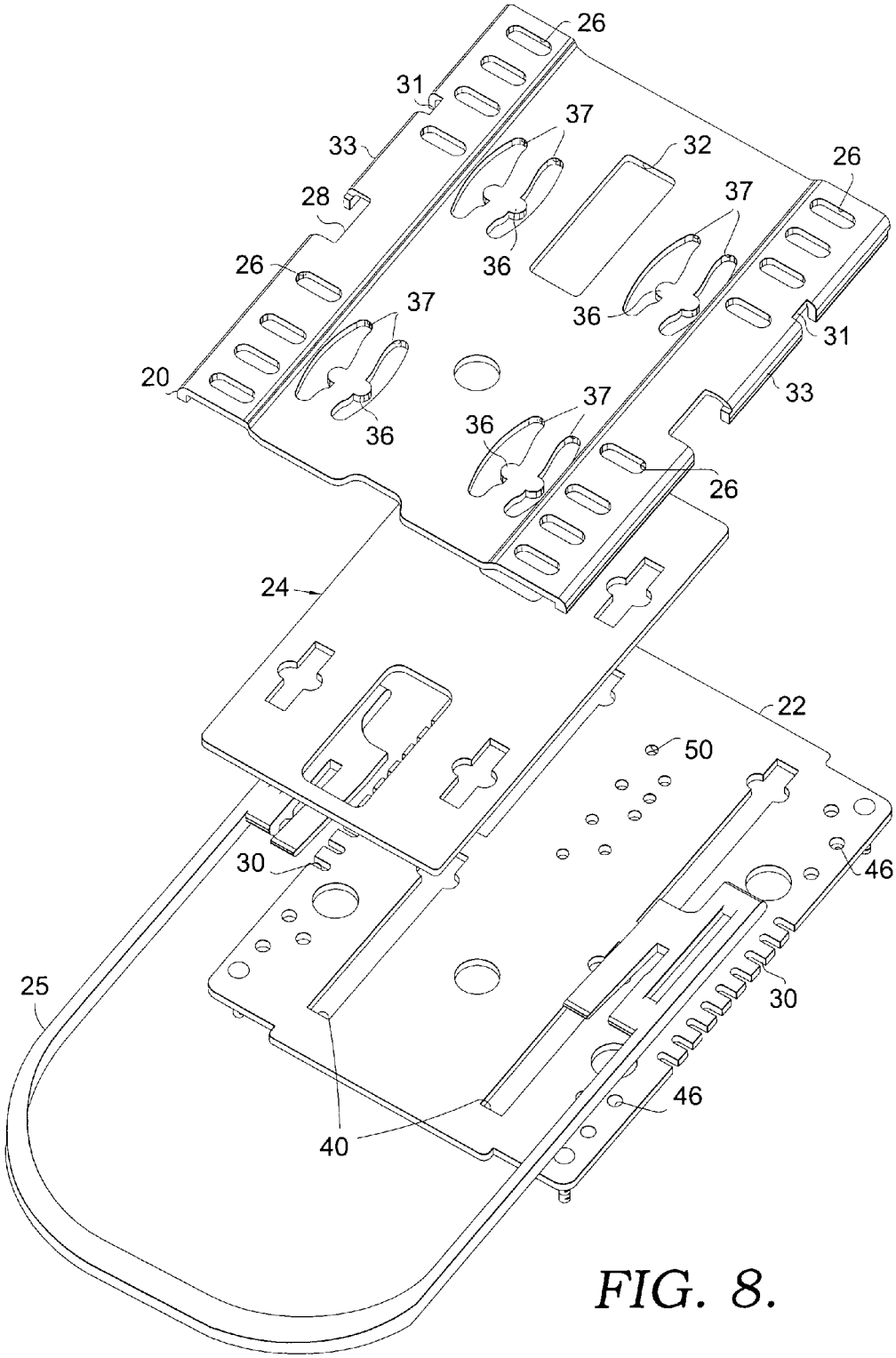
FIG. 8 is an exploded view of the adjustment mechanism.

In addition to the mounting holes, the raised profile portion 27 further includes a downward protrusion 29. As best seen in FIGS. 5 and 8, the raised profile portion 27 also includes at least one generally rectangular recess 28 located near the midpoint of the side edge. The profile portion 27 also includes a recess 31 located aft of rectangular recess 28. In the preferred embodiment, the first plate 20 includes two generally rectangular recesses 28 positioned near the midpoint of each side edge of plate 20 and two additional recesses 31 positioned aft of rectangular recesses 28. By locating recesses 31 aft of rectangular recesses 28 a pair of independent protrusions 33 are created.

Returning to FIG. 5, first plate 20 also includes a generally rectangular opening 32 positioned centrally between the side edges of plate 20. First plate 20 also includes at least one depending tab 36 which is formed within a generally circular opening 37 in the first plate. In the preferred embodiment, the first plate 20 includes four such depending tabs, two positioned near each side edge of the plate, inwardly positioned from the mounting holes 26. However, it is within the scope of the present invention to form a first plate with any desired number of depending tabs 36, in any arrangement desired.

As illustrated in FIG. 4, the tabs 36 are coupled to the first plate 20, and protrude beneath the plate by a distance sufficient to define a space 42 between an upper, locking surface of the tabs 43 and the bottom surface 44 of the plate such that the intermediate element 24 and the second plate 22 may be received in the space 42 upon assembly. Preferably, tabs 36 are integrally formed with plate 20 in a metal forming operation by removal of the material within openings 37 and a lowering of the material defining tabs 36.

Figure 7:
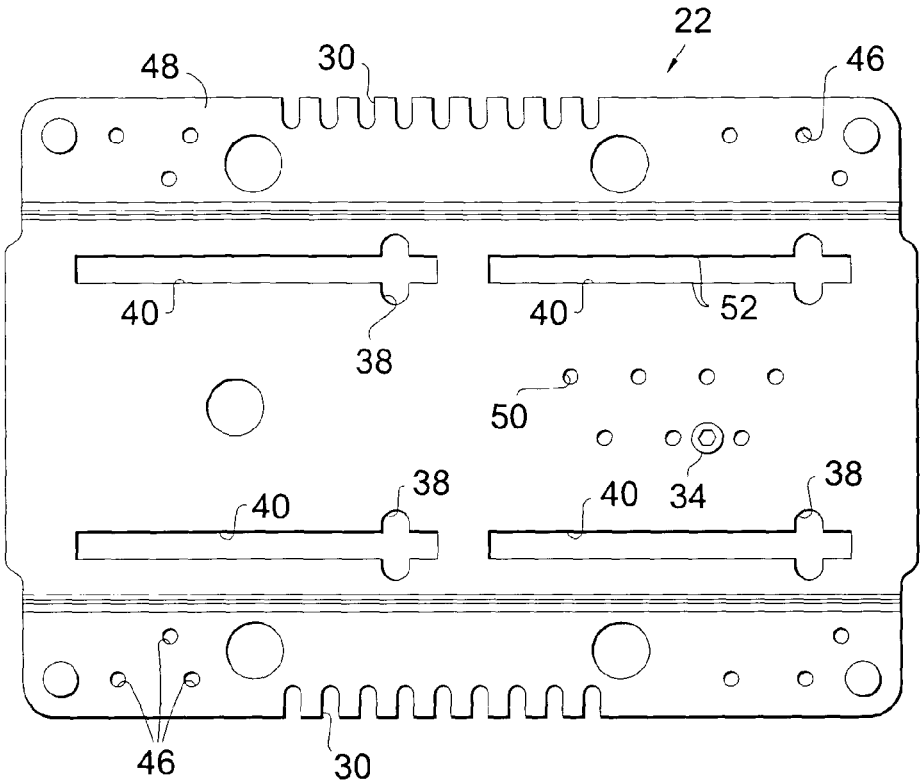
FIG. 7 is a top view of the second plate constructed in accordance with the preferred embodiment of the present invention.

Second plate 22 is illustrated in FIG. 7 and broadly includes a plurality of mounting holes 46 near the perimeter thereof which facilitate fastening the plate to the base 10 or the control mechanism 16. Second plate 22 is generally planar, presenting top and bottom surfaces and front, rear and side edges. As best seen in FIG. 3, each of the side edges is stepped to present a profile portion 48 in which the mounting holes and slots 46 are formed for receiving fasteners to connect the plate to the base 10 or the control mechanism 16. The mounting holes 46 are arranged in sets and each set presents a pattern corresponding to that of the mounting holes of the control mechanism 16 and the seat 12 such that the horizontal adjustment mechanism 18 may be interposed between the control mechanism and the seat without requiring modification of either part. As such, the adjustment mechanism 18 may be offered in combination with any conventional chair, including or not including a control mechanism, to permit fore-to-aft adjustment of the chair seat relative to the seat back. Preferably, multiple sets of mounting holes 46 are formed in second plate 22 so that the adjustment mechanism may be assembled on the chair in multiple fore-to-aft positions. However, it is possible to form the plate with only a single set of mounting holes if desired.

In addition to mounting holes, second plate 22 includes a plurality of receiving notches 30 located near the midpoint on at least one of the side edges. Notches 30 are recessed and aligned to receive projections located on adjustment lever 25. In the preferred embodiment, the second plate 22 includes two sets of receiving notches 30 located near the midpoint on the side edges. Second plate 22 also includes a plurality of positioning holes 50 spaced across a portion of the second plate, the holes positioned to align with opening 32 of the first plate 20 when the assembly is constructed. Each hole 50 is adapted to receive a stop or stops 34 such as an assembly screw or the like, such that the stop or stops 34 can be selectively positioned in any one or two of the holes 50 in order to adjust the range of possible movement of the plates relative to one another during use.

Second plate 22 further includes a plurality of apertures 40, each of which includes a pair of longitudinal edges 52, a pair of lateral edges and an enlarged portion 38, the enlarged portion positioned near one of the lateral edges. The enlarged portion 38 is sized slightly larger than the outer perimeter of tabs 36 of the first plate such that the tabs 36 may pass through openings 38, the importance of which is more fully described below.

Figure 6:
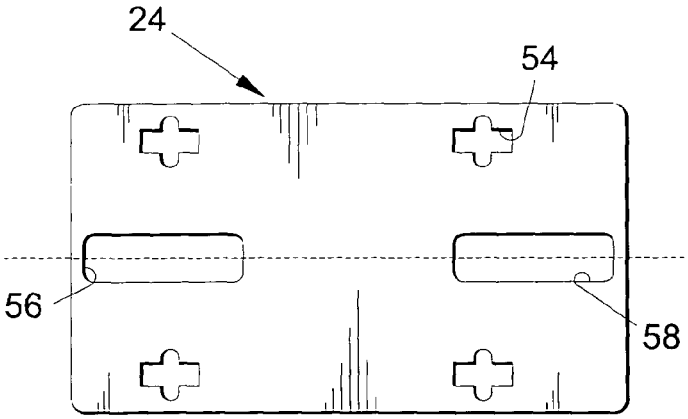
FIG. 6 is a top view of the intermediate element or spacer constructed in accordance with a preferred embodiment of the present invention.

Intermediate element or spacer 24 is illustrated in FIG. 6. The spacer 24 is preferably formed of a low-friction material, such as a polyethylene, polypropylene or nylon. For ease of manufacture, in the preferred embodiment, the spacer is generally symmetrical along its longitudinal axis, represented by a dashed line in FIG. 6. The spacer presents at least one opening 54 sized slightly larger than the tabs 36 of the first plate 20. In the preferred embodiment, the openings 54 are positioned to align with the tabs 36 of the first plate 20, the number of openings 54 corresponding to the number of tabs. However, a number of openings 54 which exceeds the number of depending tabs 36 is also contemplated to be within the scope of the present invention. Spacer 24 further presents two generally rectangular apertures 56, 58, one of which is positioned to align with the opening 32 of first plate 20 upon assembly. In an alternative embodiment, spacer 24 is not a separate element, but is formed as a coating on plate 20 or plate 22. In this embodiment, the low-friction coating could also be applied to both plates 20 and 22.

Figure 9:
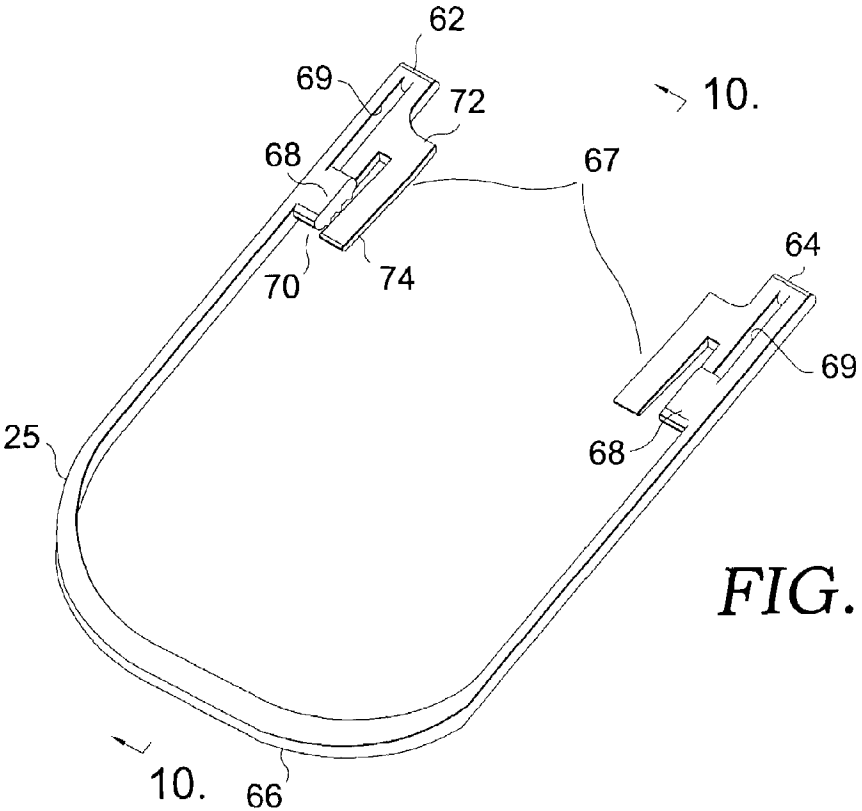
FIG. 9 is top plan view of the handle.
Figure 10:
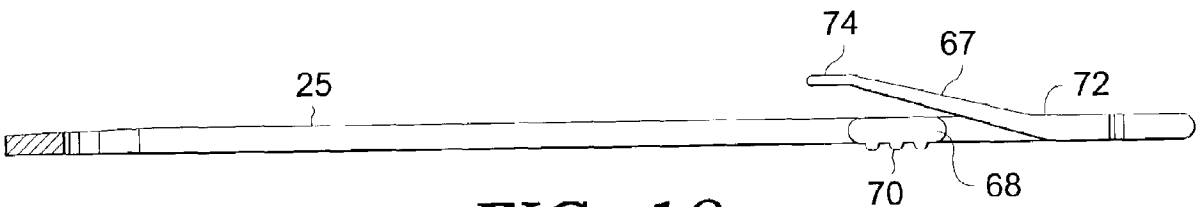
FIG. 10 is a cross-sectional side view of the handle taken along line 10-10 of FIG. 9.

As illustrated in FIGS. 9 and 10, adjustment lever 25 is generally U-shaped, including first and second ends 62, 64 separated by a bend 66. Lever 25 is generally constructed from molded plastic or any other suitable material having similar characteristics. First and second ends 62, 64 include tension arms 67, mating blocks 68, and recessed depressions 69. Tension arms 67 consist of two portions. The first portion projects inwardly from ends 62, 64 to form the upper arm 72. The second portion extends from the upper arm 72 toward bend 66 to form the lower arm 74. As best seen in FIG. 10, lower arms 74 extend upwardly at a slight angle to provide a resistant member. Mating blocks 68 are located inward of ends 62, 64 and are sized for receipt in rectangular recesses 28 of plate 20. Recessed depressions 69 are located inward of ends 62, 64 and are sized to receive protrusions 33 of plate 20. As best seen in FIG. 10, a number of adjustment projections 70 protrude downwardly from the bottom surface of the mating block 68. Adjustment projections 70 are adapted for receipt in notches 30 located on second plate 22. Projections 70 are further adapted to selectively position first plate 20 relative to second plate 22, as is more fully described below.

In the preferred embodiment, each of the first and second plates are formed from a single die stamping and the intermediate element 24 and handle 25 are injection molded. Accordingly, excepting securing and assembly screws and the like, the mechanism of the present invention is assembled from only four parts. The assembly can be reduced to as few as three parts if intermediate element 24 is formed as a coating on either plate 20, plate 22, or both plates 20 and 22. As such, manufacture and assembly are both simpler and less expensive than prior art horizontal adjustment mechanisms.

Figure 2:
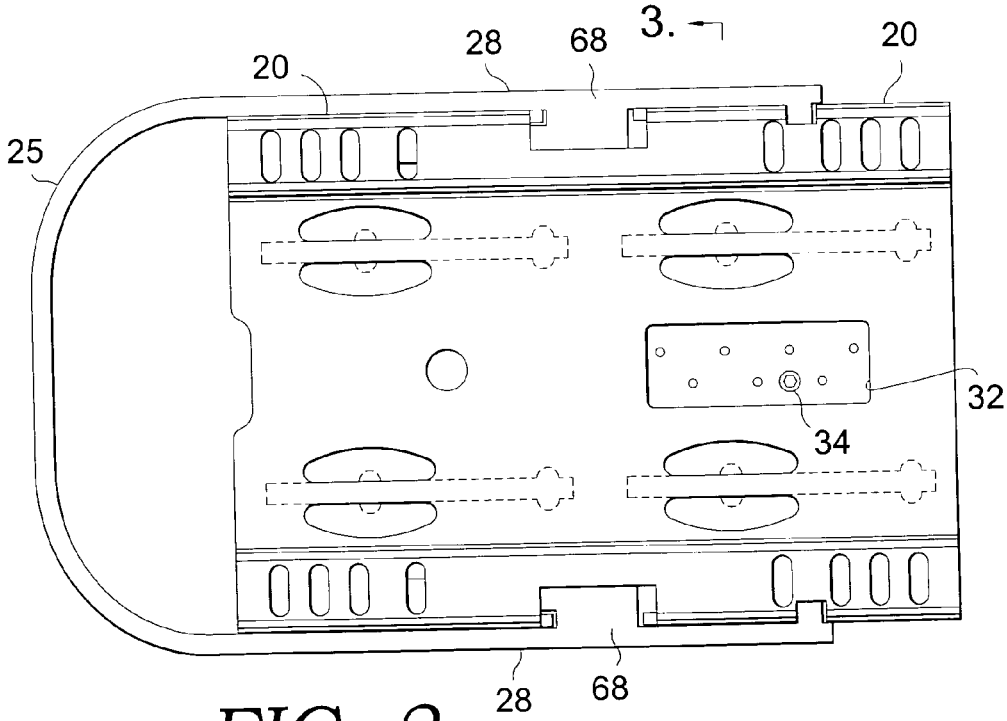
FIG. 2 is a top view of the assembled mechanism illustrating the layered interconnection of the first plate, second plate and intermediate element or spacer.

FIG. 8 shows an exploded embodiment of the horizontal adjustment mechanism 18. The assembled horizontal adjustment mechanism 18 is illustrated in FIGS. 2 and 3. It can be appreciated that the first plate 20 is guided for movement relative to the second plate 22 by the tabs 36 coupled to the first plate that are received within the apertures 40 of the second plate. The handle 25 is sandwiched between first plate 20 and second plate 22. More specifically, mating blocks 68 on handle 25 are inserted into rectangular recesses 28 contained on first plate 20. The tabs 36 are received in the enlarged portion 38 of apertures 40 and subsequently slid within the apertures along the longitudinal edges 52 thereof. The outwardly extending portions of tabs 36 extend beyond apertures 40, thus maintaining the assembled relationship of plate 20, element 24, plate 22, and handle 25. The adjustment projections 70 contained on the underside of mating blocks 68 serve to engage notches 30 on outer edges of second plate 22.

Due to the elongated nature of apertures 40, first plate 20 can slide relative to plate 22. Element 24 acts as a spacer and to facilitate the sliding movement between plates 20 and 22. The range of this sliding movement is limited by the stop 34 which engages the edges 33 of the opening 32 at each extent of the sliding movement. Stop 34 is also positioned to prevent inadvertent release of the plates of the mechanism by preventing realignment of the tabs 36 with the enlarged portion 38 of apertures 40 after assembly. In addition, during such sliding movement, the adjustment projections 70 are removed from engagement with notches 30, thus allowing the first plate 20 to move relative to second plate 22. When the stop 34 is inserted in one of the positioning holes 50, the maximum range of potential horizontal adjustment is approximately two and one-half inches due to the dimensions of opening 32. Due to the many positioning holes 50 presented, however, a single chair utilizing the horizontal adjustment mechanism of the present invention is capable of accommodating a great majority of the user population. As is apparent from the construction, stop 34 provides limits on movement. If one of the edges 33 of the opening 32 in the first plate 20 contacts the stop 34, movement in the corresponding direction will cease. Stop 34 preferably is placed by the manufacturer during the assembly of the mechanism to suit the requirements of the user. The position of a second stop 34, however, may be added to limit travel by the user if desired. Spacer element 24 is positioned and held between first and second plates 20, 22. During assembly tabs 36 are placed through openings 54 in element 24 before being placed through enlarged portions 38 of plate 22. Further, apertures 56 and 58 are positioned to allow clearance for stop 34 arrangement.

As best illustrated in FIG. 3, the assembled horizontal adjustment mechanism is relatively low profile. The approximate height of the assembly, from the top surface of the raised profile portion of first plate to the bottom surface of the profile portion 48 of the second plate being only about ⅝ inch. Consequently, when assembled on a chair, the height of the seat is raised by only approximately ⅝ inch.

In operation, to adjust the seat 12 to a position further from the seat back 14, a user provides a vertical pulling force to the bend 66 of lever 25 and provides either a pulling force to the front edge of the seat or a pushing force to the back edge of the seat. The vertical force causes the lever 25 to pivot about ends 62, 64 at recesses 31 and the attachment projections 70 to disengage from notches 30 in which they rest. The horizontal pushing or pulling force causes the seat 12 to slide. In order to cease the sliding motion of the seat 12, the user simply releases the lever 25 at the desired position and the tension arms 67 force the adjustment projections 70 to engage notches 30.

To adjust the seat 12 closer to the seat back 14, the user again provides a vertical pulling force to the lever 25 and either provides a pulling force to the back edge of the seat or a pushing force to the front edge of the seat. As stated above, the vertical force causes the lever 25 to pivot about ends 62, 64 at recesses 31 and the attachment projections 70 to disengage from notches 30 in which they rest. The horizontal pushing or pulling force causes the seat 12 to slide. In order to cease the sliding motion of the seat 12, the user simply releases the lever 25 at the desired position and the tension arms 67 force the adjustment projections 70 to engage notches 30. Both of the adjustments described above are accomplished without the need for the user to exit the chair.

Constructed and operated as previously described, this invention provides a horizontal adjustment mechanism for a chair which may be used with any conventional chair, with or without a tilt control mechanism, that includes a seat and a base. The adjustment mechanism may be employed between the seat and the control mechanism or the base without requiring modification of either part. Further, this invention provides a horizontal adjustment mechanism for a chair that is relatively low profile and does not significantly increase the overall height of the seat relative to the ground, causing a change in height of only approximately ⅝ inch.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A horizontal adjustment mechanism for use with a chair having a base, a seat supported on the base and defining a fore-to-aft longitudinal axis, and a seat back, the mechanism comprising:

a first plate adapted to be coupled to the seat, the first plate having an opening;

a second plate adapted to be coupled to the base, the second plate having a plurality of positioning holes arranged in a predetermined pattern, the holes positioned to align with the opening, said second plate being slidably coupled to said first plate such that said first and second plates can move relative to one another along the longitudinal axis of the seat; and a lever, said lever containing a first mating portion adapted to be releasably received in a recess located in the first plate and a second mating portion including a projection adapted to be releasably received in a plurality of notches located on the second plate wherein said lever is operable to selectively engage the second mating portion and one or more of said notches and is operable to selectively release the second mating portion from one or more of said notches to allow the first plate to move relative to the second plate.

2. The adjustment mechanism as recited in claim 1, wherein an intermediate element is positioned between said first and second plates for facilitating relative sliding movement therebetween.

3. The adjustment mechanism as recited in claim 2, wherein the intermediate element is integral with a bottom surface of the first plate, the second plate, or both.

4. The adjustment mechanism as recited in claim 3, said recess being generally rectangular and located at a midpoint of the first plate.

5. The adjustment mechanism as recited in claim 4, said second mating portion including a plurality of projections.

6. The adjustment mechanism as recited in claim 5, wherein said plurality of notches are integrally formed with said second plate.

7. The adjustment mechanism as recited in claim 6, said opening including an edge around a perimeter thereof, wherein each said hole is adapted to receive a stop, said stop positioned to restrict a range of fore-to-aft movement of the seat relative to the seat back by engaging selected portions of said opening edge.

8. The adjustment mechanism as recited in claim 7, said first plate further including a lower surface having at least one depending tab, said tab having an upper locking surface, wherein said tab is coupled with said first plate and protrudes from said lower surface by a distance sufficient to define a space between said locking surface of said tab and said lower surface, said space adapted for simultaneous receipt of said intermediate element and said second plate.

9. The adjustment mechanism as recited in claim 8, wherein said at least one depending tab is integrally formed with said first plate.

10. The adjustment mechanism as recited in claim 9, said second plate further including at least one aperture having a pair of longitudinal edges, said aperture including an enlarged portion sized to allow said depending tab to pass there through, wherein said longitudinal edges are positioned to align with said tab, said tab sliding within said aperture to guide relative movement of said first and second plates.

11. The adjustment mechanism as recited in claim 10, wherein said first plate includes four said tabs and said second plate includes four said apertures.

12. The adjustment mechanism as recited in claim 11, said first plate further including a plurality of mounting holes for securing said first plate to a bottom surface of the seat, and said second plate further including a plurality of mounting holes for securing said second plate to an upper surface of the base.

13. The adjustment mechanism as recited in claim 12, wherein said intermediate element is formed from a low-friction material.

14. The adjustment mechanism as recited in claim 9, wherein said intermediate element comprises at least one opening sized to allow said tab to pass there through.

15. The adjustment mechanism as recited in claim 13, said intermediate element further including first and second apertures, wherein said first aperture of said intermediate element is positioned to align with said opening of said first plate and said second aperture of said intermediate element is adapted to align with a detent of said first plate and said notches of said second plate to facilitate selective, relative sliding movement of said first and second plates.

16. The adjustment mechanism as recited in claim 14, wherein said intermediate element has a longitudinal axis in parallel to the longitudinal axis of said seat, said intermediate element being symmetrical along the longitudinal axis thereof.

17. The adjustment mechanism as recited in claim 14, said intermediate element further including a piece of material protruding from said at least one opening, wherein said piece of material is adapted for receipt in said aperture of said second plate for reducing contact between said first and second plates.

18. The adjustment mechanism as recited in claim 17, wherein said piece of material is integral with said intermediate element.

19. The adjustment mechanism as recited in claim 18, further comprising a means for coupling said first plate, said spacer, and said second plate to one another, wherein said means for coupling can be selectively engaged and released.

20. A horizontal adjustment mechanism for use with a chair having a base, a seat supported on the base and defining a fore-to-aft longitudinal axis, and a seat back, the mechanism comprising:

a first plate having an opening and being adapted to be coupled to the seat;

a second plate having plurality of positioning holes arranged in a predetermined pattern configured to align with said opening in said first plate, said second plate being adapted to be coupled to the base and slidably coupled to said first plate such that said first and second plates can move relative to one another along the longitudinal axis of the seat; and a U-shaped lever, said U-shaped lever containing a mating portion adapted to be releasably received in a first recess located in the first plate and a mating projection adapted to be releasably received in a first set of notches located on the second plate wherein said U-shaped lever is operable to selectively engage the mating projection and one or more of said notches and is operable to selectively release the mating projection from one or more of said notches to allow the first plate to move relative to the second plate; and an intermediate element positioned between said first and second plates for facilitating relative sliding movement therebetween, said intermediate element being integral with a bottom surface of the first plate, the second plate, or both.

21. The adjustment mechanism as recited in claim 20, said opening including an edge around a perimeter thereof, wherein each said hole is adapted to receive a stop, said stop positioned to restrict a range of fore-to-aft movement of the seat relative to the seat back by engaging selected portions of said opening edge.

22. The adjustment mechanism as recited in claim 21, said first plate further including a lower surface having at least one depending tab, said tab having an upper locking surface, wherein said tab is coupled with said first plate and protrudes from said lower surface by a distance sufficient to define a space between said locking surface of said tab and said lower surface, said space adapted for simultaneous receipt of said intermediate element and said second plate.

23. The adjustment mechanism as recited in claim 22, wherein said at least one depending tab is integrally formed with said first plate.

24. The adjustment mechanism as recited in claim 23, said second plate further including at least one aperture having a pair of longitudinal edges, said aperture including an enlarged portion sized to allow said depending tab to pass there through, wherein said longitudinal edges are positioned to align with said tab, said tab sliding within said aperture to guide relative movement of said first and second plates.

25. The adjustment mechanism as recited in claim 24, wherein said first plate includes four said tabs and said second plate includes four said apertures.

26. The adjustment mechanism as recited in claim 25, wherein said intermediate element is formed from a low-friction material.

27. The adjustment mechanism as recited in claim 20, wherein first plate includes a second recess.

28. The adjustment mechanism as recited in claim 27, wherein the mating portion includes first and second mating portions, the first and second mating portions adapted to be releasably received in the first and second recesses.

29. The adjustment mechanism as recited in claim 28, said first and second recesses being generally rectangular and located at a midpoint of the first plate.

30. The adjustment mechanism as recited in claim 29, wherein the second plate contains a second set of notches.

31. The adjustment mechanism as recited in claim 30, wherein the mating projection includes first and second mating projections, the projections being adapted to be releasably received in the first and second set of notches.

32. The adjustment mechanism as recited in claim 31, said first and second mating projections including a plurality of projections.

33. The adjustment mechanism as recited in claim 32, wherein said first and second set of notches are integrally formed with said second plate.

* * * * *